US007895779B2

(12) United States Patent
Schnuckle

(10) Patent No.: US 7,895,779 B2
(45) Date of Patent: Mar. 1, 2011

(54) DISPLAY DEVICE WITH FLYING OBJECTS THAT HOVER RANDOMLY AND IN FLIGHT PATTERNS

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 599 days.

(21) Appl. No.: 11/679,631

(22) Filed: Feb. 27, 2007

(65) Prior Publication Data

US 2008/0207084 A1 Aug. 28, 2008

(51) Int. Cl.
*G09F 19/08* (2006.01)

(52) U.S. Cl. ..... 40/417; 40/414; 40/430; 446/330; 446/358; 446/361; 446/366; 446/490; 119/708

(58) Field of Classification Search ..... 446/30–32, 446/230, 268, 330, 358, 361, 366, 33; 40/414, 40/427, 417; 472/7; 43/1–3; 119/707, 708
See application file for complete search history.

(56) References Cited

U.S. PATENT DOCUMENTS 1,507,710 A * 9/1924 Pohlman ..... 446/30
3,136,544 A * 6/1964 Strayer ..... 472/11
3,546,811 A * 12/1970 Kupperman et al. ..... 446/33
3,858,872 A * 1/1975 Summerfield et al. ..... 472/7
4,930,448 A * 6/1990 Robinson ..... 119/708
4,949,486 A * 8/1990 Belokin et al. ..... 40/414
5,146,702 A * 9/1992 Belokin, Jr. ..... 40/430
5,322,036 A 6/1994 Merino
5,657,721 A * 8/1997 Mayfield et al. ..... 119/707
5,823,844 A * 10/1998 Markowitz ..... 446/175
5,924,387 A 7/1999 Schramer
5,964,638 A 10/1999 Emerson
6,038,812 A * 3/2000 Belokin et al. ..... 47/41.01
6,152,799 A 11/2000 Arriola
6,572,428 B1 6/2003 Weiser et al.
6,700,248 B2 * 3/2004 Long ..... 310/80
6,715,228 B1 4/2004 Price
6,743,072 B2 * 6/2004 Nelson et al. ..... 446/490
D499,665 S 12/2004 Weiser
6,843,702 B2 1/2005 Weiser
6,845,579 B2 * 1/2005 Weiser ..... 40/427
6,892,675 B1 * 5/2005 Comerford ..... 119/708
6,907,688 B2 * 6/2005 Brint ..... 43/2
7,536,823 B2 * 5/2009 Brint ..... 43/2

* cited by examiner

*Primary Examiner* — Gene Kim
*Assistant Examiner* — Scott Young
(74) *Attorney, Agent, or Firm* — Marsh Fischmann & Breyfogle LLP; Kent A. Lembke

(57) ABSTRACT

An apparatus hovering winged objects. The apparatus includes an elongate support and a driver with an output shaft that supports a first end of the support. The driver imparts an oscillating displacement to the first end of the support. A body is mounted at a second end of the support and wings are attached to the support at an offset distance from the body. The body is positioned near the second end to swivel or pivot in response to vibration of the support. The driver vibrates the first end at a frequency that shapes the support as a wave, and the frequency is selected or tuned such that the wings are displaced more than the body such by imparting a harmonic frequency on the support. The output shaft is positioned by the driver in angular positions to move the first end of the support and the body and wings.

18 Claims, 8 Drawing Sheets

DISPLAY DEVICE WITH FLYING OBJECTS THAT HOVER RANDOMLY AND IN FLIGHT PATTERNS

BACKGROUND OF THE INVENTION

1. Field of the Invention

The present invention relates, in general, to toys, display systems, products, and other devices in which one or more components simulate objects in flight such as a flying bird or butterfly and, more particularly, to a system for controlling an object, such as an object imitating a hummingbird, a bat, a bird, a fairy, or the like, to selectively place the object in flight while also allowing the object to hover randomly or in a controlled pattern.

2. Relevant Background

In nature, there are many creatures that not only fly by flapping their wings but also that are able to hover. For example, a hummingbird is a fascination to many as it beats its wings so rapidly the wings are nearly invisible while it hangs fluttering in the air or moves about a location such as fluctuating to and fro near a bird feeder. Many other creatures hover including other birds, bats, and insects such as butterflies. Additionally, there are many other imaginary creatures such as fairies, unicorns, vampires, and many others that hover when they are depicted in movies.

An ongoing challenge has beBen how to simulate not only the ability of such creatures to fly but also to hover with their wings beating but their bodies remaining relatively still or steady. For example, when a hummingbird hovers about a feeder, its wings are hard to see but its colorful body and head are readily visible to an observer. Existing products that try to simulate a hummingbird tend to be made of a solid body with wings formed of wispy or translucent material that may move in a wind or simply remain still but provide some appearance of movement due to its wispy nature and/or translucence. Generally, such products are fixed in place and so cannot move about a location or object as would be expected of a real hummingbird. Many flying toys have been developed over the years in which wings are provided that flap rapidly to help the glider-like toy fly with the wings typically being driven by a mechanical device such as a coiled spring or rubber band or by a small motor. These toys generally only simulate flight and cannot be made to hover, and when tethered, these flying toys generally fly repeatedly in a circle. Existing devices that provide motion to butterflies or moths provide a butterfly body that is attached rigidly to a free end of a wire. The wire is moved about at the opposite, attached end of the wire such as by a wheel that rotates. The wire's movements cause the butterfly body to move about and attached flexible wings to move to simulate flight. The butterfly devices do not effectively simulate hovering of the butterfly as the body jitters about with the end of the wire and cannot remain in one position, and further, the flight pattern is fixed and becomes repetitive and boring to an observer.

Hence, there remains a need for a device for causing a winged object to fly with its wings moving or beating and also to hover with its body still or stationary relative to the wings. Further, it is desirable for the flight pattern of the winged object to be controllable (such as from a perch to another perch or reactive to external stimuli or occurrences or the like) and/or in a relatively random pattern (such as to move about an area and then hold a position for a period of time and then move about again in an unpredictable manner or to simply continue to move in a pattern that is or appears undefined or at least not preset).

SUMMARY OF THE INVENTION

The present invention addresses the above problems by providing winged object systems or devices in which a winged object such as a hummingbird or fairy is made to fly from one location to another and to also hover at each of these locations with its body relatively still or stable while the wings are moving rapidly. Generally, the systems of the invention achieve a hovering effect by providing a long support such as a wire or flexible beam that is fixed at one end or is supported in a cantilevered manner. A winged object is provided at the unsupported end of the support wire or beam with a body that is mounted on or near the end so as to be able to swivel or pivot freely. Two or more wings are provided in the winged object and are mounted rigidly to the support and at an offset distance. The system further includes a driver that has an output connected to the fixed end of the support, and the driver output is caused to vibrate to impart a harmonic motion to the support. The vibration of the driver output is typically tuned or adjusted such that the wings move substantially more than the body such that the wings appear to flap or beat while the body remains relatively motionless, and in some cases, the body is positioned near a nodal position of the support while the wings are mounted a distance away from this nodal position (i.e., a position of minimal displacement of a vibrating element). The now hovering winged object is moved about through a flight pattern or number of locations by moving the output of the driver either randomly (e.g., to imitate a hummingbird's or other creature's natural movements) or in a selected pattern (e.g., from a resting perch to another perch or to select locations in a display). Such movement of the winged object may be in response to external stimuli such as activation of an electronic device (e.g., a phone receiving an incoming call, a lamp being turned on, or the like), as the winged object system is useful in numerous consumer and other products.

More particularly, an apparatus is provided for providing winged objects that hover in various positions or locations. The apparatus includes an elongate support such as a wire, a flexible rod, a beam, or the like. A driver is provided with an output shaft that supports a first end of the support. The driver operates to impart an oscillating displacement to the first end of the support by vibrating the first end of the support. The apparatus further includes a winged object assembly that includes a body that is mounted proximate to a second end of the support. The winged object assembly also includes wings that are rigidly attached to the support at an offset distance from the body. The second end of the support is typically unsupported and the body is positioned on a receiving surface on or near the second end so as to not be rigidly attached but to be able to swivel and/or pivot on the receiving surface in response to movement or vibration of the support. The driver may operate to vibrate the first end at a frequency that shapes the support as a wave or in a wave displacement pattern, and the frequency and pattern are selected or tuned such that the wings are displaced more than the body, e.g., by selecting a harmonic or a resonant frequency of the support. The output shaft is positioned selectively by the operation of the driver (e.g., an X-Y servomotor or the like) into a plurality of angular positions so as to move the first end of the support into a corresponding plurality of X-Y positions, which causes the winged object to move to a number of locations or to fly through a flight pattern. The angular positions of the output shaft are set by control signals from a controller in some embodiments, and these control signals may be issued in response to stimuli input (such as sensing of light, sound, or movement) or external control signals (such as an activation signal from an electronic device) received by the controller.

DETAILED DESCRIPTION OF THE PREFERRED EMBODIMENTS

Briefly, the present invention is directed to a system or apparatus that includes a winged object that appears to move or flap its wings to fly while its body remains relatively still or stable to provide the appearance of hovering as the winged object moves about randomly and/or in controlled flight patterns. For example, the system may include a lamp and a winged object, such as a fairy, bird, butterfly, or the like, may be positioned above or near the lamp to hover, with some embodiments providing a relatively random pattern or positioning or a more controlled flight pattern. Generally, systems of the present invention include a winged object assembly mounted upon a free end of a wire or thin beam that is rigidly attached at its other end to a driver (e.g., to provide a cantilevered beam or support). The driver vibrates the beam or wire to cause the beam to move and in many embodiments, the vibration is tuned to impart harmonic motion on the beam by rapidly and repeatedly displacing the fixed end of the beam or support. The wings of the object are mounted so as to vibrate or move with the beam while the body of the winged object is mounted so as to remain still or to move less than the wings so as to appear steady or still (e.g., by mounting the body at or near a node (i.e., a point of minimum movement when an object such as the elongate support is subjected to a harmonic frequency causing the support to have a standing wave shape) of the support while the wings are mounted at an offset distance from a node). The driver may also provide positioning of the support to move the now hovering winged object through a flight pattern such as by moving the fixed end of the support randomly, in a preset pattern, or in a pattern selected based upon external stimuli. In this manner, the winged object not only appears to hover but also to fly about in the systems of the present invention to effectively simulate movement of imaginary creatures such as fairies and creatures found in nature such as hummingbirds and insects.

Figure 1:
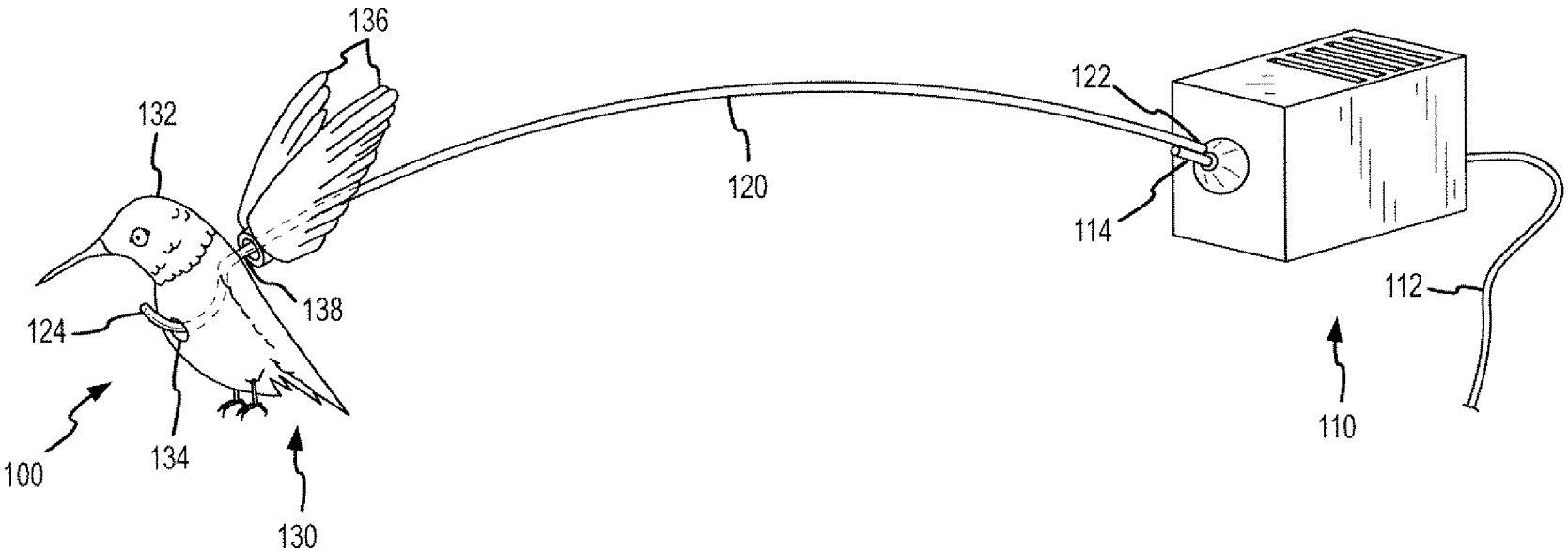
FIG. 1 is a perspective view of a winged object system of the present invention that is adapted to simulate that the winged object is hovering in various locations.

FIG. 1 illustrates a winged object system 100 of the present invention. As shown, the system 100 includes driver 110 that is powered and optionally controlled by connection or connecting wires 112. The driver 110 includes an output 114 such as an output shaft. An elongate and flexible support 120 is mounted at a fixed end 122 to the output 114 of the driver 11. The flexible support 120 generally may be thought of as a cantilevered beam with a fixed end 122 and a free end 124 that is distal to the fixed end 122. The support 120 may take many forms to practice the invention, and in some embodiments, the support 120 is a length of piano wire such as a few inches up to several feet in length. In other embodiments, the support 120 is formed of materials other than metal such as plastic and may have differing cross sections such as square or rectangular and may be much larger in cross section (e.g., have a larger diameter than piano wire) although thicker and/or longer supports 120 may require a more powerful and structurally large driver 110 to obtain desired motion or vibration of the support 120.

The free end 124 provides a mounting point for a winged object or assembly 130, and in some embodiments, is a swivel attachment similar to swivel attachments used in fishing or may be a latchable or open hook (as shown). Generally, the free end 124 is configured to support a body 132 of the winged object 130 by mating with a swivel point or opening 134 of the body 132. As shown, the support or free end 124 is simply a hooked or curved portion of the support 120 and the body 132 includes a hole or opening 134. The opening 134 often is provided at about the center or center of gravity for body 132 although this is not required. The winged object 130 further includes one or more wings 136 that are attached to the support 120 an offset distance from the body 132. As shown in FIG. 1, the wings 136 are attached rigidly via a mounting element 138 (to which they are affixed) so as to move with the support 120.

The wings 136 are generally formed of a flexible material such as thin sheets of plastic or metal or of fabric so as to flutter or flap when the support is vibrated or moved quickly about and are generally attached rigidly to the mounting element 138. The shape and number of the wings 136 is selected based on the creature or object being simulated by the assembly 130, e.g., an imaginary creature such as a fairy, a unicorn, a flying car, and the like or a creature of nature such as a bird, a bat, a dinosaur, an insect, or the like. The specific configuration of the wings such as their material or their dimensions such as width and length is not considered limiting of the invention but, in general, the wings 136 are designed to oscillate, beat, or move through a range of positions quickly in response to vibrations on the support 120 and to be resilient so as return to an "at rest" position.

The body 132 is mounted upon the support 120 a distance from the mounting member 138. In some embodiments, the body 132 is mounted rigidly to the support 120 while in some preferred embodiments, the body 132 is mounted as shown to freely pivot on the support 120 or more specifically, at or near the free end 124. Such pivotal mounting allows the body 132 to stay more stable or steady (i.e., to not move as much) when the free end 124 oscillates or moves when vibrations are imparted to the support 120 at the fixed end 122 by the driver 110. As with the wings 136, the body 132 may take many forms to practice the invention and is generally selected to take on the appearance of the body of an object (e.g., an imaginary or natural creature) that is being simulated by the assembly 130. In one example, the assembly 130 is a fairy and the wings 136 are formed of rubber, thin plastic, or fabric with a length of about 3 to 6 inches and a width of about 0.5 to 3 inches while the body 132 is formed of plastic, metal, glass, ceramic, or the like and is about 3 to 8 inches in length, 0.5 to 3 inches in width, and 0.1 to 2 inches in thickness (with a flatter body working well in one implementation). The body 132 and wings 136 may also be colored, shaped, and textured to better simulate the creature being simulated or imitated. Of course, these are only exemplary materials and dimensions as the concepts of the invention may be used with numerous other embodiments and applications.

Figure 2:
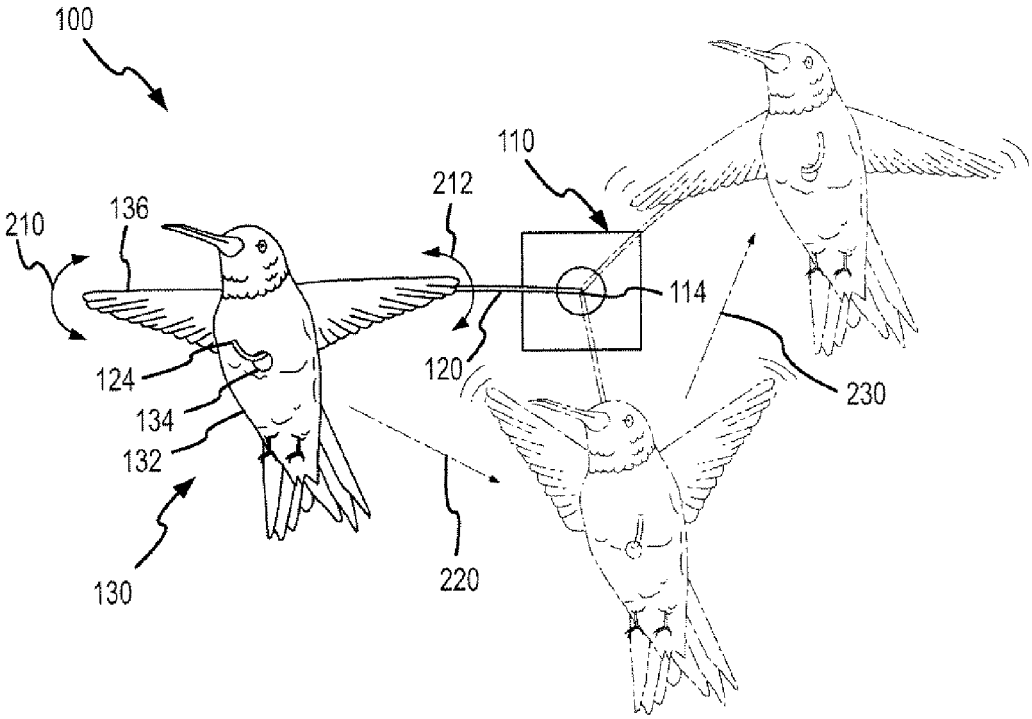
FIG. 2 illustrates the system of FIG. 1 as it is operated to move the hovering, winged object between various locations, e.g., in a controlled/selected flight pattern or in a more random pattern, with the wings moving or beating in response to an oscillating/vibrating support wire while the body remains relatively still (i.e., moves with X-Y repositioning of the wire but does not vibrate or oscillate with the wire)

The driver 110 functions to support the fixed end 122 of the support, to position the assembly 130 by moving the fixed end 122 of the support 120, and to cause the wings 136 to move or flap. The combination of the movement of the assembly 130 and its body 132 in combination with the movement of the wings 136 while the body 132 remains stable causes the assembly 130 to appear to be flying and also hovering (e.g., when the support 120 is held in a single position). FIG. 2 illustrates operation of the winged object system 100. As shown, the driver 110 is operated first to vibrate the fixed end 122 of the support 120 such that the wings 136 move as shown at 210, 212. The movement 210, 212 may be up and down relative to the support 120 or more of a back and forth motion as shown, with either resulting in the appearance of beating wings especially when the movement is rapid (e.g., in response to a relatively high frequency vibration or oscillation by the driver 110) and being a translation of the motion of the support 120 into motion of the wings 136. The driver 110 may then move the support to a new position such as a new X-Y position by moving the output shaft 114 with the movement to the second or new position shown at 220. This movement 220 provides the appearance of flight for the object 130 as the wings 136 continue to beat 210, 212 during the movement 220. Later, the object 130 is moved 230 to a third or another position by the driver 110 moving the fixed end 122 by moving the output shaft 114 to a new X-Y position. The particular hovering locations may be relatively random to provide an unpredictable flight pattern for the object 130 or may be preset by the driver 110 such as fixed movements 220, 230 in response to an external stimuli or signal to the driver 110 or as part of running a flight pattern routine by the driver 110 or by a controller attached to the driver 110 by lines 112. Generally, the new positions of the assembly 130 are radial positions on a spherical flight pattern with the support 120 being the radius of the sphere or portion of a sphere surface over which assembly 130 may be positioned by the driver 110.

The driver 110 may take numerous forms to provide these functions. Generally, the driver 110 acts as a shaker that is driven with displacement at its output 114 (e.g., in the Y or X direction) to displace the fixed end 122 of the cantilevered support 120 to cause the support 120 to vibrate along its length. It is preferred that the body 132 moves less than the wings 136 and in some cases to move little or not at all. To this end, the body 132 may be mounted differently so as to swivel or move relative to the support 120 while the wings 136 are mounted rigidly to move with the support 120. Alternatively or more preferably in combination, the body 132 is mounted at an offset distance from the wings 136. The driver 110 is selected to be adjustable so as to impart harmonic motion in the support 120 or to cause beam or support 120 to vibrate at its resonant frequency or at one of its harmonic frequencies.

In other words, the driver 110 applies a vibration signal at its output 114 to the fixed end 122 of the support 120 that causes the support 120 to oscillate with a pattern associated with a standing wave made up of nodes (i.e., points of minimum amplitude in the standing wave or movement of the support 120) and antinodes (i.e., positions of maximum amplitude in the standing wave or movement of the support 120). The driver 110 is tuned or adjusted (or the length and configuration of the support 120 is selected) such that the body 132 moves significantly less than the offset mounting member 138 and wings 136. This can be achieved in some cases by tuning the system 100 such that the body 132 and/or the free end 124 are at or near a node or nodal position while the mounting member 138 and wings 136 are not and may be more proximate to an antinode or position of greater movement of the support 120 when it is vibrated by the driver. The magnitude of the displacement or amplitude of vibration waves is also adjusted such that a desired amount of movement of the wings 136 is achieved, and this will vary with the size of wings 136, the weights and material of the wings, and other physical characteristics of the wings 136.

Hence, the driver 110 may include a mechanical shaker device to impart the vibration or displacement of the fixed end 114. Alternatively, one or more strips of piezoelectric material may be attached to the support 120 so as to change the shape of the support 120 with an alternative current passing through the strip such that the support 120 vibrates at the frequency of the current. By tuning the frequency of the input current, the driver 110 can change the vibration frequency until it meets the resonant frequency of the support 120. In other embodiments, the driver 110 includes a DC servomotor with an output shaft 114 that can be both vibrated at a desired frequency and amplitude and that can be moved quickly and accurately to new X-Y positions to move the fixed end 122 or pivot point of the support 120 so as move the winged object 130 through a desired flight pattern. Generally, the servomotor has an output shaft 114 that can be positioned by sending a coded signal to the motor, and as the input to the motor changes, the angular position of the output shaft 114 changes as well to move the fixed end 122 of the support 120 (e.g., the fixed end 122 can be thought of as having a new X-Y position or to have a new angular position relative to a starting point at 0,0 in an X-Y coordinate system). Such an X-Y servo and DC motor combination may control the vibration or displacement of the fixed end 122 by vibrating the output shaft 114 in response to a signal generator such as a sine wave generator or a galvanometer. The control or input signal (or vibratory signal or control) is in some embodiments tuned for the support 120 and assembly 130 combination such that the support 120 vibrates, the wings 136 oscillate or move with the support 120, and the body 132 does not move or moves with less amplitude than the wings 136 so as to appear stable, i.e., the support 120 is driven with a wave shape that causes oscillations in the wings 136 but not in the body 132. This may be at the harmonic frequency of the support 120 with the assembly 130 positioned at or near the free end 124, e.g., with the body 132 at or near a nodal position of the oscillating support 120 and the wings 136 offset from this nodal position.

Figure 3A:
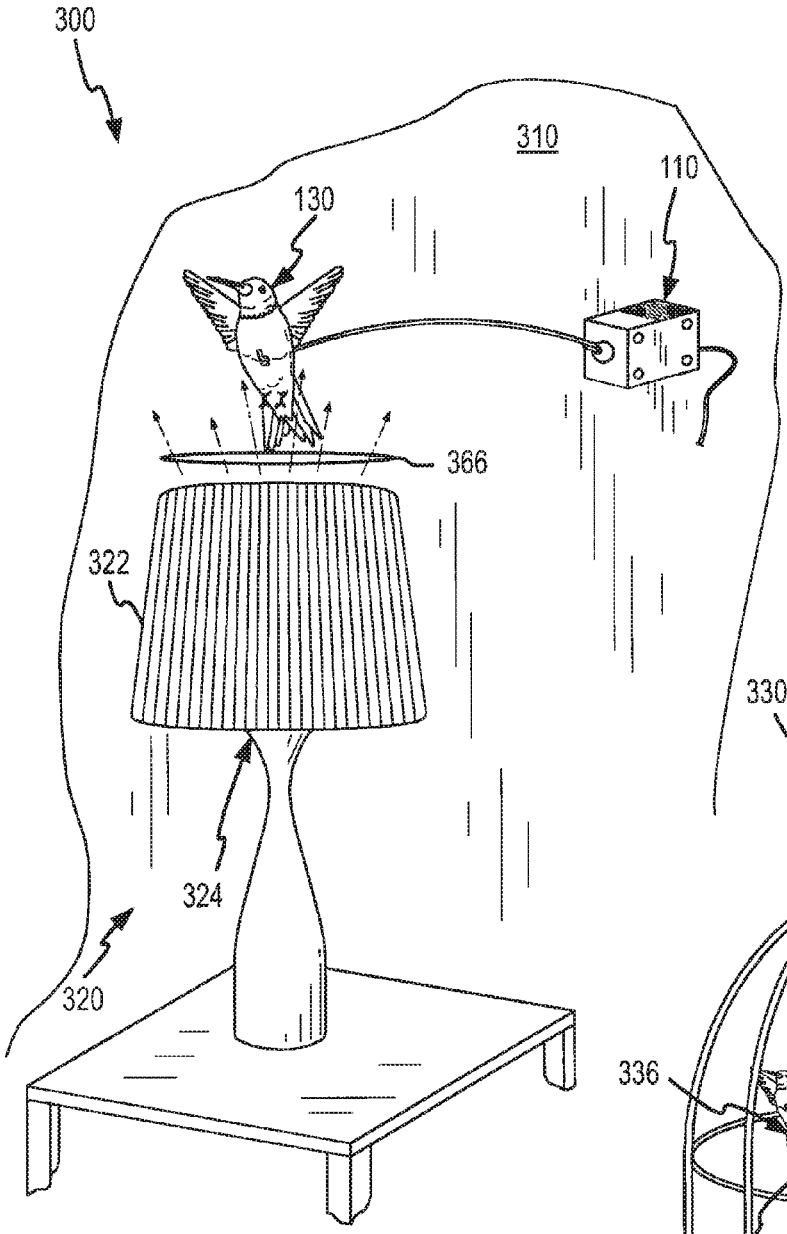
FIGS. 3A-3C illustrate three exemplary assemblies, such as consumer products, that incorporate winged object systems or assemblies of the invention, such as those shown in FIGS. 1 and 2.
Figure 3B:
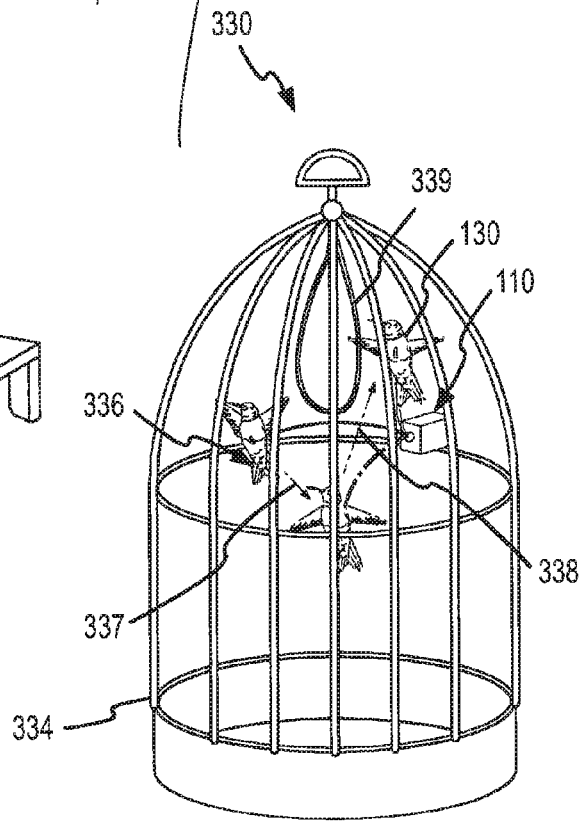
Figure 3C:
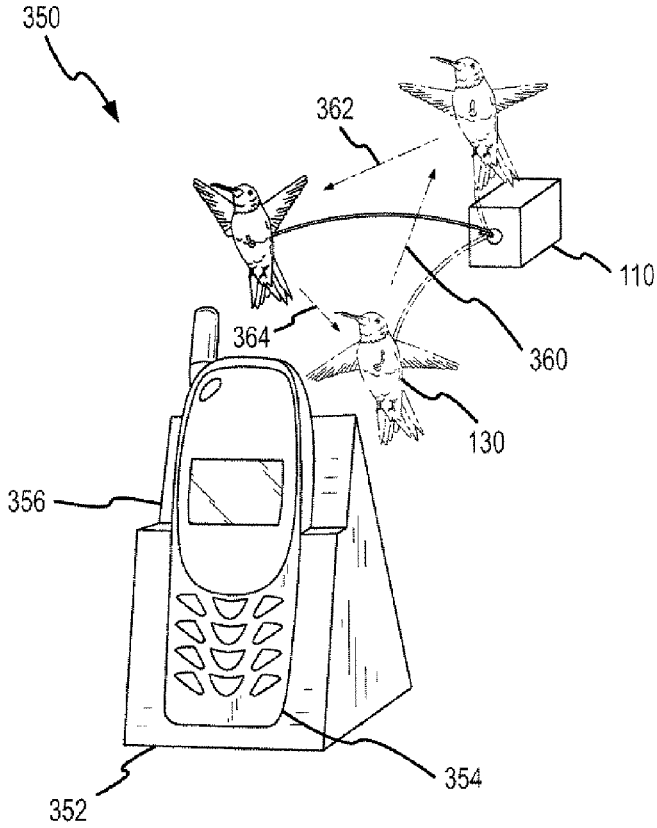

The system 100 may be used as a standalone product to display a hovering object. In other applications, the system 100 is combined with other components to provide assemblies such as may be sold to retail or business consumers. FIGS. 3A-3C illustrate three representative assemblies 300, 330, and 350. The assembly 300 includes the system 100 along with a lamp 320. The driver 110 may be mounted on a wall 310 or other support structure near the lamp 320 such that the winged object 130 rests on a perch or support on or near the lamp 320 and hovers and flies above or near the lamp 320 (such as when the light is turned on or when a separate switch or control is activated on the lamp 320 or linked to the driver 110). The lamp 320 includes a bulb 324 and a lamp shade 322 and generates light 366. In some embodiments, the object 130 is positioned to be displayed in the light 366 above the lamp 320 or to fly in and out of such light through its flight pattern provided by the driver 110.

FIG. 3B illustrates an assembly or product 330 in which all or portions of the system 100 are provided within a housing, e.g., a bird cage or the like, 334. The driver 110 is operated such that the winged object 130 may rest on a perch or support 336 or swing 339 and hover in the housing 334 or move about the housing 334 as shown at 337 and 338. The movement 337, 338 and vibrating of the support 120 to oscillate the wings 136 may be performed at some preset interval, in a randomly generated pattern, and/or in response to control signals (such as from an external control device such as a manually operated joystick or controller or in response to stimuli such as light or noise or the like).

FIG. 3C shows another assembly 350 in which a system 100 may be provided to achieve a desired display of a hovering creature or object 130. As shown, the driver 110 is mounted on a wall or support structure and operates to position the winged object on a perch or support 356 when it is at rest (e.g., when the support 120 is not vibrating or vibrating slowly). The driver 110 also operates to move 360, 362, 364 the winged object through a number of positions or locations at which it appears to hover due to the vibration of the support 120 that causes the wings 136 to move with little or no movement of the body 132. The assembly 350 further includes a base 352 (such as a recharging or synchronizing base) and a device 354 such as a cell phone, wireless phone, a personal digital assistance, a laptop or other computer device, or the like. In some embodiments, the assembly 350 is configured to provide a signal such as from the base of 352 to the driver 110 to have the driver operate automatically in response to activity at the base 352. For example, the winged object 130 may be caused to hover when the device 354 is returned to the base 352 and/or when it is activated (such as when an incoming message or call is received by the device 354). The flight pattern defined by the movements 360, 362, 364 may be random, relatively random, preset for any type of activation, or be matched to a particular activation (e.g., for one flight pattern when a message is received, for another pattern when a call is incoming from a known caller, for another pattern when a call is incoming from an unknown caller, or combinations of these and other implementations). For example, in one embodiment, the winged object 130 leaves the perch 356 when the phone 354 rings and proceeds through the positions 360, 362, 364 and returns (after a preset or random flight pattern or after repeating the flight pattern until the device 354 is returned or the call is ended).

Figure 4:
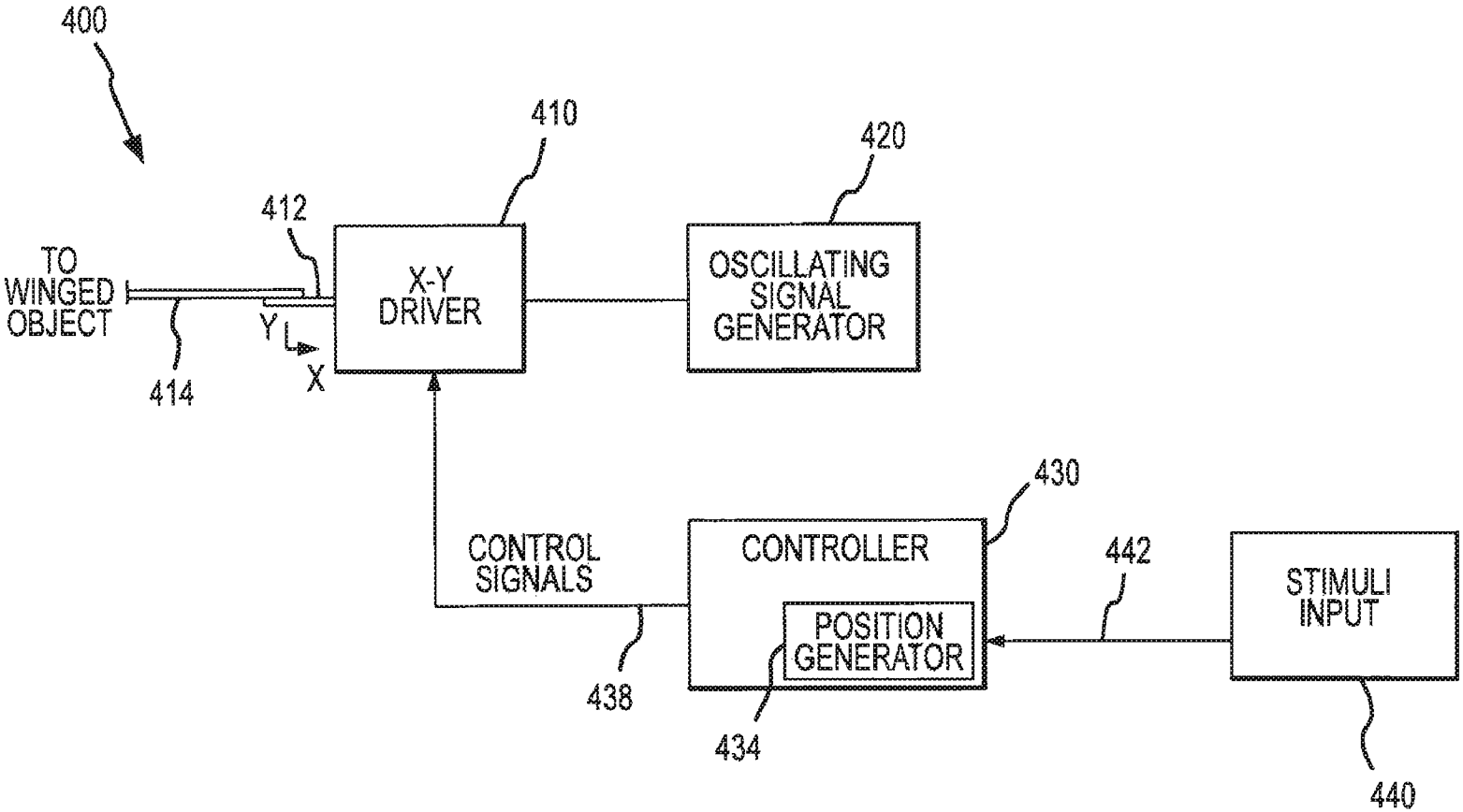
FIG. 4 is a functional block diagram of a winged object system of the present invention.

FIG. 4 illustrates a functional block diagram of a winged object system 400 of the present invention, which may be used to implement the system 100 or systems 300, 330, 350. As shown, the system 400 includes an X-Y driver 410 with an output shaft 412 that is attached to a fixed end of a support 414, which in turn is attached to a winged object (not shown). The output shaft 412 is positioned by the driver 410 in a variety of X-Y positions (or differing angular positions) to cause the support 414 and an attached winged object to move in a particular pattern (e.g., a flight pattern). The output 412 is also caused to vibrate at a frequency and amplitude that is set by an input signal generator or oscillating signal generator 420. The signal generator 420 is preferably tuned or adjusted after a winged object is mounted upon the free end of support 414 to cause the output shaft 412 to vibrate at a frequency that causes the wings to move but the body to remain relatively stable when compared with the wings. As discussed earlier, this may be a harmonic or resonant frequency for the support 414 with the winged object at the free end or such that the body is at a nodal position in the vibration wave applied to the support 414.

The system 400 farther includes a controller 430 that provides control signals 438 to the driver 410. These control signals 438 generally activate the driver 410 to impart vibration to the output shaft 412 based on output of the signal generator 420. The control signals 438 also are used to set the X-Y position of the output shaft 412. The position control signals 438 may be manually input such as with an operator operating a user interface (e.g., joystick, keyboard, mouse, or the like). In other embodiments, the position control signals 438 are provided by a position generator 434, which may be a computer routine that provides the position control signals 438. The position generator 434 may include routines to generate random positions and timing of movements so as to cause the output 412 to move about randomly to create an predictable flight path or pattern. The position generator 434 may also or instead include one or more predefined flight patterns that are implemented based on time (e.g., repeat after a predefined or randomly selected amount of time elapses). In other cases, the random or preset patterns provided by the position generator 434 are selected or initiated by input 442 from a stimuli input 440. For example, the input 440 may be a switch such that when a device (such as a lamp or display on/off switch) is operated the input 440 provides a signal 442 that causes the generator 434 to provide certain position control signals 438. The stimuli input 440 may also include sensors such as light or sound sensors such that the input 442 causes the generator 434 to provide a particular flight pattern in response to the stimuli signal 442. In other cases, the stimuli input 440 may be an external controller or device that transmits activation signals to the controller 430 to use one or more routines of the generator 434 to provide control signals 438 to the X-Y driver 410.

Figure 5:
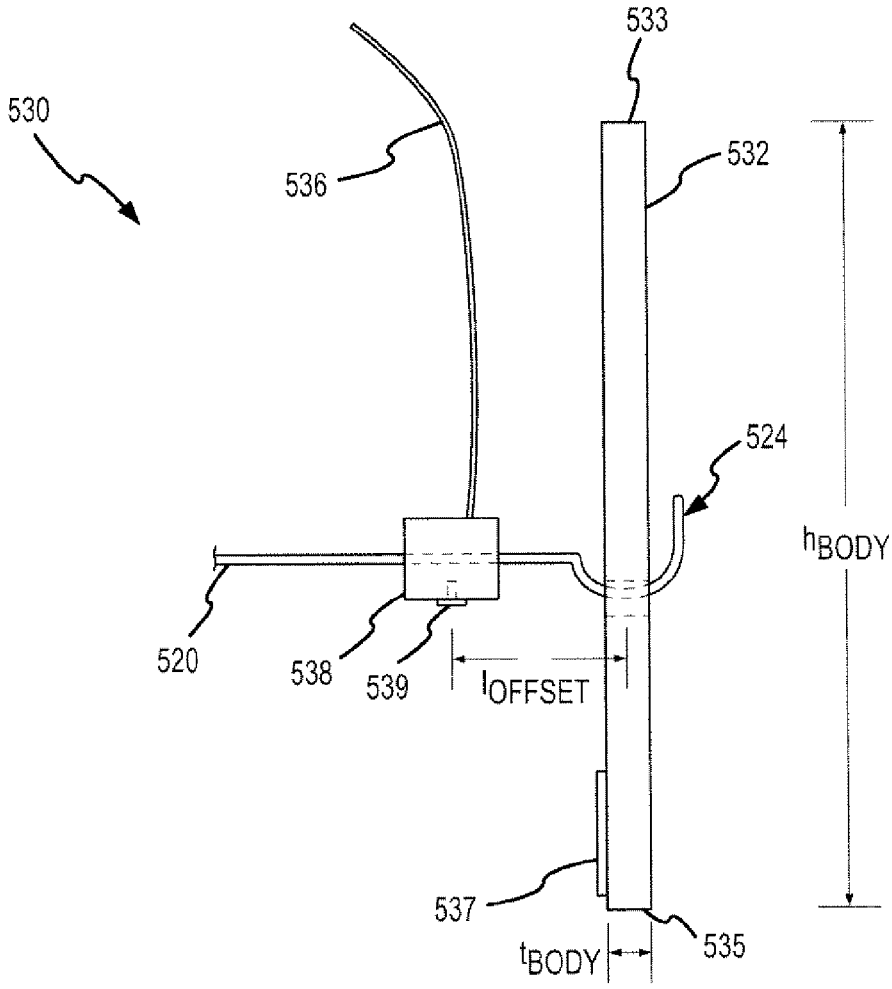
FIG. 5 is an enlarged, partial side view of a winged object system illustrating the tip of a support wire with a swivel point or pivotal support mount upon which a body of a winged object is positioned or mounted and a pair of wings or wing assembly is rigidly mounted at an offset distance from the body.

FIG. 5 illustrates in more detail the mounting of a winged object 530 to a support 520. As discussed above, the support 520 is cantilevered at a fixed end (not shown in FIG. 5) and extends out from this fixed end to an unsupported or free end 524. The free end 524 is configured to allow a body 532 to be mounted such that the body 532 is free to swivel or pivot. This may be achieved in a number of ways such as latchable swivels that are attached to the body 532 or with a hook or support end 524 extending through the body 532 or through an eyelet or other component (not shown) on the backside of body 532. The support 520 is typically selected to have adequate strength and rigidness to support the weight of the body 532 and wings 536 and to be fairly easily made to oscillate with vibrations applied to the fixed end. For example, when the body 532 and wings 536 are relatively light (a few ounces or less) and the length of the support 520 is relatively short (less than about 3 feet), a metal wire (such as piano wire) may be used for support 520 although it may bend somewhat when it supports the assembly 530. If the assembly 530 is heavier and/or the support 520 is relatively long, the support 520 may need to be formed with a larger diameter or more rigid material to better support the assembly in a cantilevered fashion.

As shown, the body 532 includes a top or head 533 and a bottom or base 535 and the support end 524 typically is attached to the body between these two ends 533, 535 such as about midway or at or near a center of gravity for the body 532. A counterweight 537 may be provided on the body 532 near the base 535 so as to cause the body 532 to remain more steady or motionless when the support 520 oscillates or vibrates. Alternatively, the base 535 may be designed to be heavier than the top 532. The body 532 has a height, $h_{body}$, and a thickness, $t_{body}$, that may be varied to practice the invention but generally the thickness, $t_{body}$, is chosen to be relatively small compared to the height, $h_{body}$, such as at less than about 1 inch and more typically less than about 0.25 inches while the height may be up to 6 inches or much more.

The wings 536 typically are selected to have dimensions that correspond or are proportionate to the body 532. The wings 536 are typically thin and formed of a material that allows the wings 536 to flex or bend along their lengths when the support 520 vibrates (such as metal, fabric, rubber, or plastic wings that are less than about 0.25 inches and more typically less than 0.125 inches thick and are 2 to 6 inches or more in length). The wings 536 are attached (e.g., rigidly mounted) to the mounting member 538 which in turn is rigidly mounted to the support 520 such as with a set screw or fastener 539 or by other methods. Alternatively, the wings 536 may be attached directly to the support 520 without an additional mounting member 538. The wings 536 are mounted to the support 520 at an offset distance, $l_{offset}$, from the location of the body 532 on the free end 524 as may be measured from center (or a plane passing through the center of gravity of the body 532) of the body 532. The offset distance, $l_{offset}$, is selected based on the sizes of the wings 536 and body 532 and the flexibility of the support 520 with larger offsets typically being used with larger wings 536 and bodies 532 and less flexible supports 520. For example, in one preferred embodiment, the offset distance, $l_{offset}$, is selected from the range of 0.1 to 1 inch with one embodiment using an offset of less than about 0.375 inches, but in larger embodiments of the assembly 530, an offset distance, $l_{offset}$, of several inches or more may be useful. As discussed above, the offset distance, $l_{offset}$, allows the body 532 to be positioned at or near to a nodal position of a standing wave when the support 520 is vibrated (such as a harmonic frequency) while the offset wings are positioned distal to this nodal position such that the amplitude of the standing wave or magnitude of the displacement of the support 520 where the wings 536 are attached is greater. When combined with the pivotal or swivel mounting of the body 532 on the free end 524, this allows the wings 536 to vibrate or move a large amount relative to the body 532, which in some cases moves very little or not at all so as to appear stable.

Figure 6:
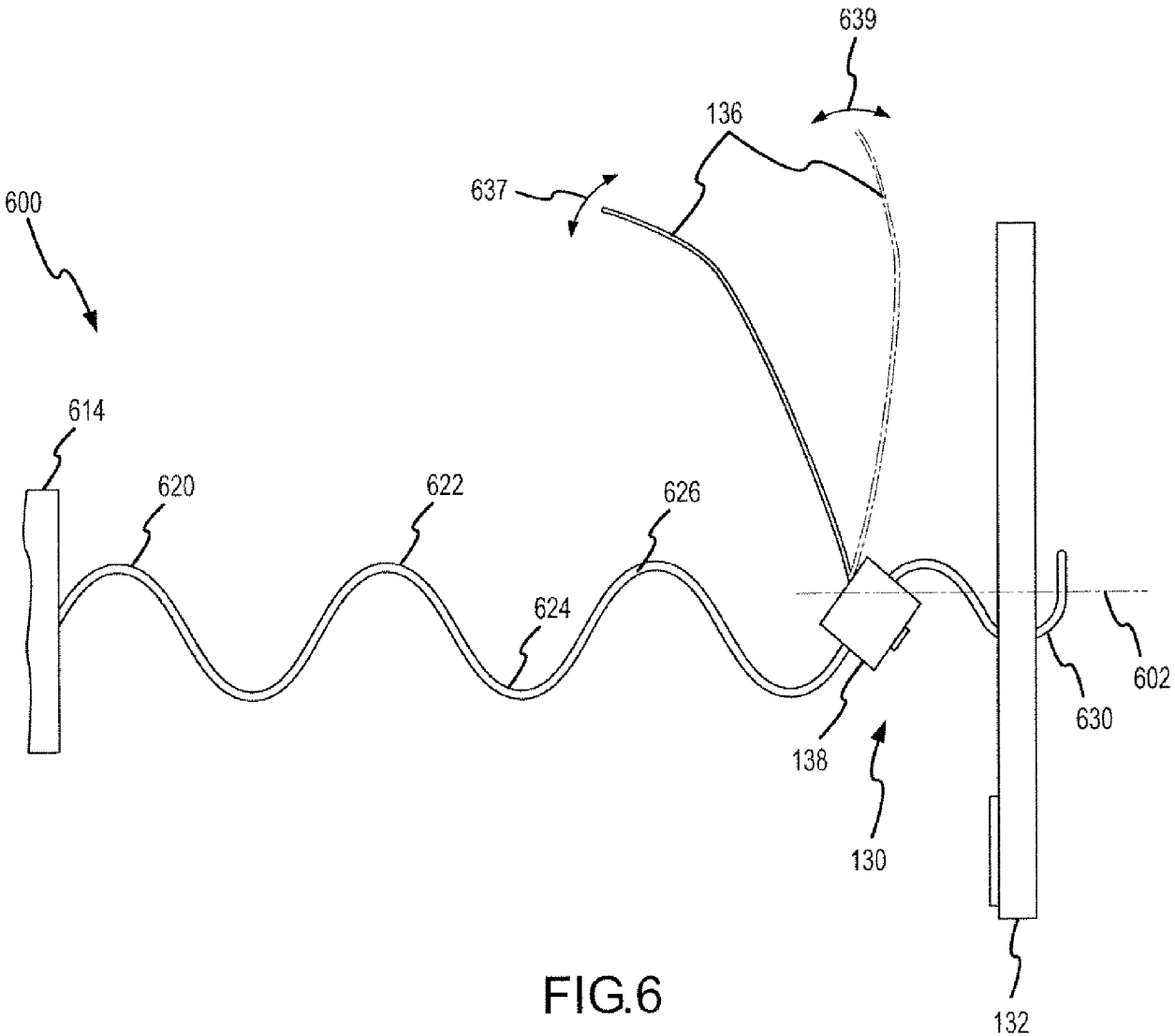
FIG. 6 is a side view of a portion of a winged object system illustrating (in an exaggerated manner) the imparting or driving of a wave into the cantilevered support wire to impart motion to wings of the winged object but little or no vibratory motion to the body that is positioned at or near a harmonic node of the support wire.

The use of the offset in positioning the two wings from the body can be seen more clearly in FIG. 6. FIG. 6 illustrates a winged object assembly 600 in which a driver or output shaft of a driver 614 is provided and a support beam 620 is fixed at one end to this driver 614. The driver 614 imparts a wave motion such as vibration at a harmonic frequency or a resonant frequency of the support 620. A wave or standing wave pattern forms in the vibrated support 620, and in this pattern, there are positions of large displacement or amplitude relative to the at rest or reference position of the support 620 (i.e., its location when not vibrated) that may be called antinodes 622, 624. However, the beam or support 620 has little or no displacement (i.e., the wave has minimal amplitude relative to the reference location or position for the support 620), and these locations may be called nodes or nodal positions 626. When the support 620 vibrates, a pair of wings 136 move up and down or side to side 637, 639 because they are mounted via mounting member 138 to a portion of the support 620 that has displacement, i.e., not at nodal position or even at or near an antinode 622, 624. In contrast, the body 132 is mounted at the free end 630 of the support 620 and, as shown, the motion imparted to the support 620 is such that the free end is at or near a nodal position 626 such that the body 132 is not displaced or the displacement relative to the reference location line 602 is minimal or at least less than the movement of the mounting member 138.

Figure 7:
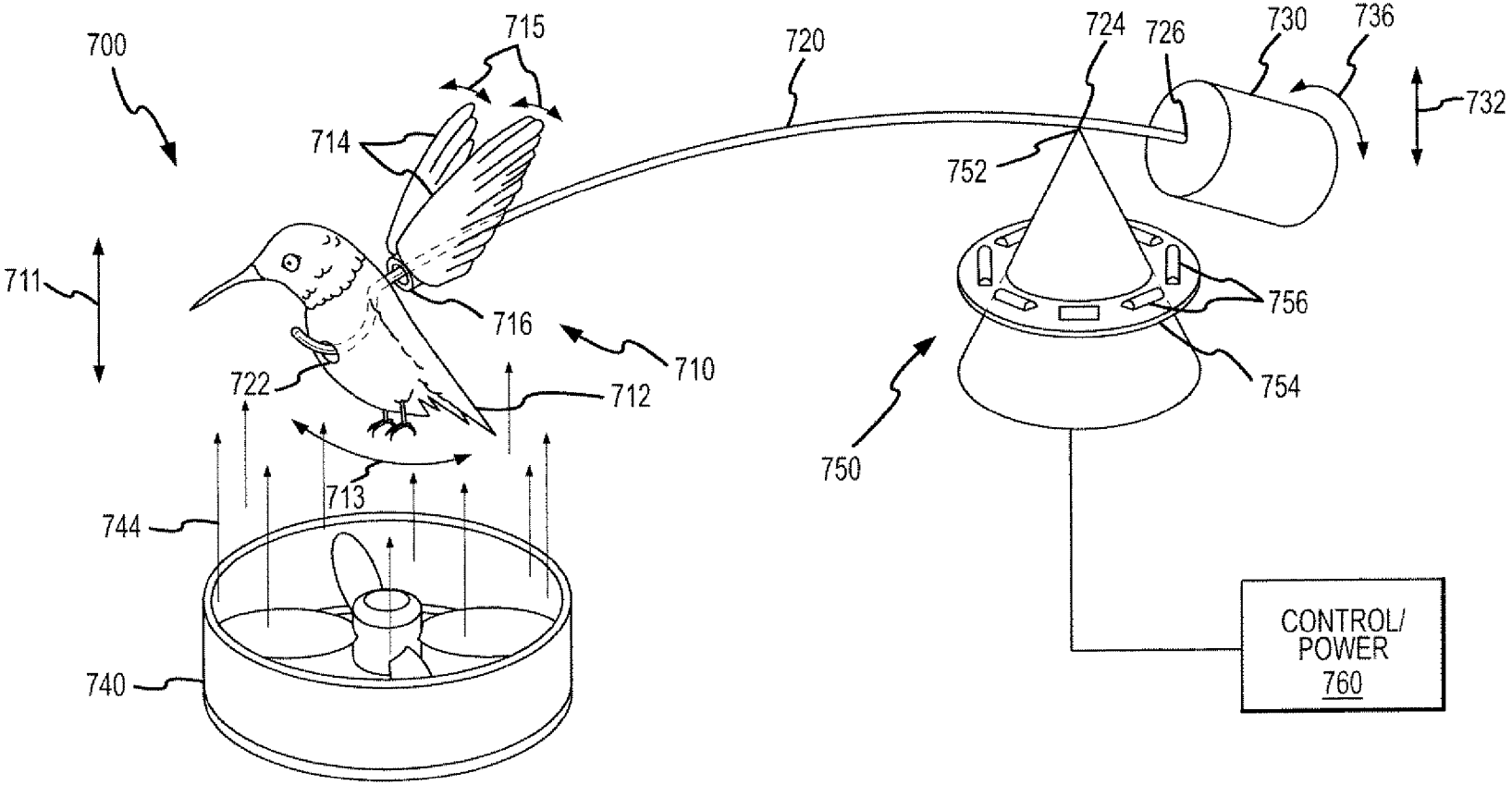
FIG. 7 is a perspective view similar to that of FIG. 1 showing another embodiment of a winged object system of the present invention using electro magnets a controlled or selected flight pattern for the hovering object and a fan to impart a random or unpredictable flight patter upon the winged object.

In some embodiments, alternative techniques are used to positions the winged object and/or to impart a random or undefined flight pattern onto the object. FIG. 7 illustrates such an alternative embodiment of a winged object system 700. As shown, the system 700 includes a winged object 710 that includes a body 712 that is connected (such as for pivoting and/or swiveling) to a free end 722 of a support 720. The object 710 further includes a wings 714 that are rigidly attached via a mounting member 716 to the support 720 (e.g., at an offset distance as discussed above). The support 720 is attached at a fixed end 726 to a driver 730, such as a torque driver or other device for imparting vibrations onto the fixed end 726 of support 720. The support 720 is also physically supported at portion 724 that is attached to a mating portion 752 of a support and positioning assembly 750. The assembly 750 includes a support structure including mount 752 and further includes positioning devices that are shown to include a shelf 754 upon which a plurality of electromagnets 756 are positioned. The winged object assembly 700 further includes a control/power unit 760 for transmitting control signals to the driver 730 (such as power on/off) and to the magnets 756 so as move the driver 730 as shown with arrows 732, 736 about the shelf 754 and toward/away the shelf 754. By selectively operating the driver 730 and energizing the magnets 756, the fixed end 726 of the support 720 can be moved and the support 720 can be vibrated to move the wings 714 as shown at 715 to cause the object 710 to move between positions in a flight pattern and to hover at such locations with little movement of the body 712, with movement of the object 710 shown at 711 and 713.

To provide a more random movement, the system 700 includes a fan 740 that supplies wind or moving air 744 when operated by the controller 760 or as turned on separately from support/positioning assembly 750. The wind 744 causes the object 710 to flutter about from position to position while pivoting about position 724 as its weight is counterbalanced by the driver 730. In typical embodiments, the driver 730 is significantly heavier than the object 710 and to provide a system that balances on mount 752 the support 720 is much longer on the object side of the point 724 than on the driver side. In other embodiments, the fan 740 is provided at an angle, along one side of the object 710, or above the object 710. In other cases, additional fans are provided so as to cause a more varying distribution of the wind 744 or this may be achieved with devices provided at the outlet of the fan 740 such as active louvers or the like. As with the systems of FIGS. 1-4, the control 760 may operate to provide random positioning of the object 710, to provide predefined flight patterns, and/or to provide movement of the object 710 in response to a particular stimuli (such as a ringing phone, an activated electronic device, detected motion, light, or sound, or the like) in a random pattern, in a predefined pattern, or in a pattern selected based on the input stimuli.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An apparatus having winged objects that hover in various positions, comprising:

an elongate support;

a driver with an output shaft supporting a first end of the support, the driver imparting an oscillating displacement to the first end of the support by vibrating the first end of the support; and a winged object assembly comprising a body mounted proximate to a second end of the support and wings rigidly attached to the support at an offset distance from the body, wherein the output shaft is positioned selectively in a plurality of angular positions by the driver to move the first end of the support into a plurality of corresponding X-Y positions, wherein the driver vibrates the first end of the support at a frequency that imparts a wave displacement pattern in the support, and wherein the wings are vibrated more than the body in response to vibration of the support.

2. The apparatus of claim 1, wherein second end of the support is unsupported and wherein the body is supported by the second end on a receiving surface and is not rigidly attached to the support, whereby the body is able to swivel in on the receiving surface in response to movement of the support.

3. The apparatus of claim 1, wherein the frequency is a harmonic frequency of the support with the winged object assembly positioned on the support and wherein the receiving surface of the body is proximate to a nodal position on the vibrating support and further wherein the wings are mounted proximate to an antinodal position of the support, whereby the body and the winos move independently from each other on the support.

4. The apparatus of claim 1, wherein the offset distance is at least about 0.1 inches and wherein the wings comprise first and second wings attached at one end to a mounting member that is rigidly attached to the support.

5. The apparatus of claim 1, wherein the angular positions of the output shaft are set by control signals from a controller and wherein at least some of the control signals are issued by the controller in response to stimuli input or external control signals received by the controller.

6. The apparatus of claim 5, wherein the stimuli input or external control signals comprise an activation indicator for an electronic device.

7. A hovering object system, comprising:

a driver with an output that vibrates at a frequency in response to an input vibration control signal and that is positioned in one of a plurality of angular positions in response to position control signals;

a support beam attached at first end to the output of the driver to have cantilevered support and to have the first end vibrated and positioned by the output of the driver;

a body pivotally mounted proximate a second end of the support beam; and wings spaced apart from the body by an offset distance and attached to the support beam.

8. The system of claim 7, further comprising a wave generator generating the input vibration control signal, wherein the wave generator is adjustable to provide the input vibration control signal at a harmonic frequency of the support beam with the body and the wings in position on the support beam.

9. The system of claim 8, wherein the second end is at or proximate to a nodal position of the support beam when vibrated at the harmonic frequency.

10. The system of claim 7, further comprising a controller generating the position control signals to move the second end of the support beam through a random or predefined pattern of hovering positions.

11. The system of claim 10, wherein the controller generates the position control signals in response to a stimuli input signal indicative of an operating environment of the system.

12. The system of claim 7, wherein the driver comprises an X-Y servo motor.

13. An apparatus for providing a hovering winged object, comprising:

a cantilevered support;

means for imparting harmonic motion to the cantilevered support;

a winged object assembly provided on the cantilevered support comprising a body positioned proximate to a nodal position of the cantilevered support and wings mounted on the cantilevered support at an offset distance from the body proximate to an antinodal position of the cantilevered support, wherein the body and the wings move independently from each other on the cantilevered support.

14. The apparatus of claim 13, wherein the body is mounted on the cantilevered support for pivoting in at least one plane and wherein the wings are rigidly mounted to the cantilevered support between the means for imparting harmonic motion and the body.

15. The apparatus of claim 13, wherein the body is mounted proximate to an unsupported end of the cantilevered support and wherein the cantilevered support comprises a length of wire.

16. The apparatus of claim 13, wherein the means for imparting harmonic motion comprises an output shaft attached to a fixed end of the cantilevered support and wherein the output shaft moves to position the fixed end of the cantilevered support in a plurality of locations.

17. The apparatus of claim 13, further comprising an electronic device, means for generating an activation signal when the electronic device is activated, and wherein the means for imparting harmonic motion operates in response to the activation signal to impart the harmonic motion to the cantilevered support.

18. An apparatus for providing a hovering winged object, comprising:

a cantilevered support;

means for imparting harmonic motion to the cantilevered support;

a winged object assembly provided on the cantilevered support comprising a body positioned proximate to a nodal position of the cantilevered support and wings mounted on the cantilevered support at an offset distance from the body, wherein the means for imparting harmonic motion comprises a metallic portion and wherein a supported end of the cantilevered support is linked to the metallic portion, further comprising a plurality of electromagnets positioned proximate to the means for imparting harmonic motion and a controller for selectively energizing the electromagnets to attract the metallic portion and position the means for imparting harmonic motion.

* * * * *

UNITED STATES PATENT AND TRADEMARK OFFICE

CERTIFICATE OF CORRECTION

PATENT NO. : 7,895,779 B2
APPLICATION NO. : 11/679631
DATED : March 1, 2011
INVENTOR(S) : Schnuckle It is certified that error appears in the above-identified patent and that said Letters Patent is hereby corrected as shown below:

IN THE SPECIFICATIONS:
Column 1, line 28, delete “beBen” and insert therefor --been--.
Column 11, Claim 3, line 35, delete “winos” and insert therefor --wings--.

Signed and Sealed this
Fifth Day of April, 2011

David J. Kappos

David J. Kappos
*Director of the United States Patent and Trademark Office*